US008668367B2

(12) United States Patent
Anderson et al.

(10) Patent No.: US 8,668,367 B2
(45) Date of Patent: Mar. 11, 2014

(54) INTERCHANGEABLE LAMP SHADE SYSTEM

(75) Inventors: Lara Anderson, Olympia, WA (US); Kathleen L. Lathrop, Olympia, WA (US)

(73) Assignee: Red Door Interiors, Olympia, WA (US)

( * ) Notice: Subject to any disclaimer, the term of this patent is extended or adjusted under 35 U.S.C. 154(b) by 1 day.

(21) Appl. No.: 13/468,916

(22) Filed: May 10, 2012

(65) Prior Publication Data

US 2012/0287650 A1 Nov. 15, 2012

Related U.S. Application Data

(60) Provisional application No. 61/485,055, filed on May 11, 2011.

(51) Int. Cl.
*F21V 1/16* (2006.01)
*F21V 11/00* (2006.01)

(52) U.S. Cl.
USPC ..... 362/357

(58) Field of Classification Search
USPC ..... 362/351–358, 360, 361, 806
See application file for complete search history.

(56) References Cited

U.S. PATENT DOCUMENTS

| | | | | |
|---|---|---|---|---|
| 2,111,844 A * | 3/1938 | Davidson | 362/359 |
| 2,606,280 A * | 8/1952 | Stroschein | 362/357 |
| 5,211,474 A * | 5/1993 | Leitner et al. | 362/351 |
| 5,662,412 A * | 9/1997 | Glendmyer | 362/351 |
| 6,729,747 B1 * | 5/2004 | Wirayani | 362/356 |

* cited by examiner

*Primary Examiner* — Stephen F Husar
(74) *Attorney, Agent, or Firm* — Holland & Hart LLP

(57) ABSTRACT

A lamp shade cover that fits snugly over a lamp shade or lamp shade liner to provide interchangeable lamp shade decor with a tailored look. In embodiments, a separating closure mechanism attaches sides of the lamp shade cover together to form a lamp shade form that fits snugly over the supporting lamp shade or lamp shade liner. In embodiments, the separating closure mechanism is a separating zipper sewn into either side of the lamp shade cover. Embodiments include an interchangeable lamp shade system that includes a lamp shade liner and one or more lamp shade covers that fit snugly over the lamp shade liner and are removable via the separating closure mechanism of the lamp shade cover.

13 Claims, 4 Drawing Sheets

INTERCHANGEABLE LAMP SHADE SYSTEM

CROSS REFERENCES

This application claims priority from U.S. Provisional Patent Application No. 61/485,055, filed May 11, 2011, entitled "INTERCHANGEABLE LAMP SHADE SYSTEM," which is hereby expressly incorporated by reference in its entirety for all purposes.

BACKGROUND

Decorative lamp shades are used in interior decorating to update the style of lamps to match the desired decor. Lampshades are attached to the lamp by way of a lamp harp, a metal wire that typically attaches below the light bulb socket. Lamp shades typically have a wire at the top and bottom that provides structure and are supported at the top wire by the finial base of the lamp harp. Lamp shades may be made from a wide range of materials including glass, fabric, or fabric with a polystyrene base material.

To update a room's decor, typically lamp shades are replaced with shades with a different color, fabric, and/or pattern to match the new decor or seasonal change. Because lamp shades are bulky and have a rigid structure they are difficult to ship and store.

SUMMARY

Described embodiments include a lamp shade cover that fits snugly over a lamp shade or lamp shade liner to provide interchangeable lamp shade decor with a tailored look. In embodiments, a separating closure mechanism attaches sides of the lamp shade cover together to form a lamp shade form that fits snugly over the supporting lamp shade or lamp shade liner. In embodiments, the separating closure mechanism is a separating zipper sewn into either side of the lamp shade cover. Embodiments include an interchangeable lamp shade system that includes a lamp shade liner and one or more lamp shade covers that fit snugly over the lamp shade liner and are removable via the separating closure mechanism of the lamp shade cover.

Some embodiments include a lamp shade cover that includes a pliable backing material in a lamp shade pattern, a decorative fabric covering adhered to the backing material, and a separating closure mechanism that detachably attaches a first and a second side of the lamp shade pattern, such that when separating closure mechanism is closed the backing material and fabric create a lamp shade cover. The separating closure may be a separating zipper or Velcro closure mechanism. The separating zipper or Velcro closure mechanism may be sewn onto the decorative fabric covering at the first and second sides of the lamp shade pattern.

In some embodiments, the lamp shade pattern may be an arc lamp shade pattern forming a truncated cone when the separating closure mechanism is closed. In other embodiments, the lamp shade pattern may be a rectangular lamp shade pattern forming a cylinder shape when the separating closure mechanism is closed. The pliable backing material may be pressure sensitive styrene.

Some embodiments are directed to a lamp shade system that includes a lamp shade liner forming a lamp shade structure and a lamp shade cover. The lamp shade cover may include a decorative fabric in a pattern formed to fit over the lamp shade liner and a separating closure mechanism separating a first and a second end of the lamp shade cover such that when the separating closure mechanism is in a closed position the lamp shade cover is configured to fit snugly over the lamp shade liner. The separating closure mechanism may be a separating zipper or Velcro closure mechanism. The separating zipper or Velcro closure mechanism may be sewn onto the decorative fabric covering at the first and second sides of the pattern.

In some embodiments, the lamp shade cover includes a pliable backing material in a lamp shade pattern, the lamp shade pattern configured to fit snugly over the lamp shade liner when the separating closure mechanism of the lamp shade cover is closed. In embodiments, the lamp shade liner comprises a top annular wire frame and a bottom annular wire frame. The top annular wire frame may have a smaller diameter than the bottom annular wire frame.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The decor of a room may be updated by replacing lamp shades to match new paint, furniture, and other home decorating accessories. For example, rooms may be updated seasonally by replacing lamp shades with shades having seasonal patterns on them. Presently, this is done by replacing the entire shade with a new shade having a different color, pattern, and/or material. Accordingly, lamp shades for different seasons must be stored. In addition, the bulkiness and fragility of lamp shades makes them difficult and expensive to store and ship.

Existing lamp shade covers do not provide the same aesthetics as traditional lamp shades. For example, lamp shade covers that are made of elasticized fabric and slip over an existing lamp shade do not fit snugly over the lamp shade. Instead, existing lamp shade covers appear baggy and wrinkled, and therefore do not provide a tailored look when installed.

Described embodiments include a lamp shade cover that fits snugly over a lamp shade or lamp shade liner to provide interchangeable lamp shade decor with a tailored look. In embodiments, a separating closure mechanism attaches sides of the lamp shade cover together to form a lamp shade form that fits snugly over the supporting lamp shade or lamp shade liner. In embodiments, the separating closure mechanism is a separating zipper sewn into either side of the lamp shade cover. Embodiments include an interchangeable lamp shade system that includes a lamp shade liner and one or more lamp shade covers that fit snugly over the lamp shade liner and are removable via the separating closure mechanism of the lamp shade cover.

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Figure 1:
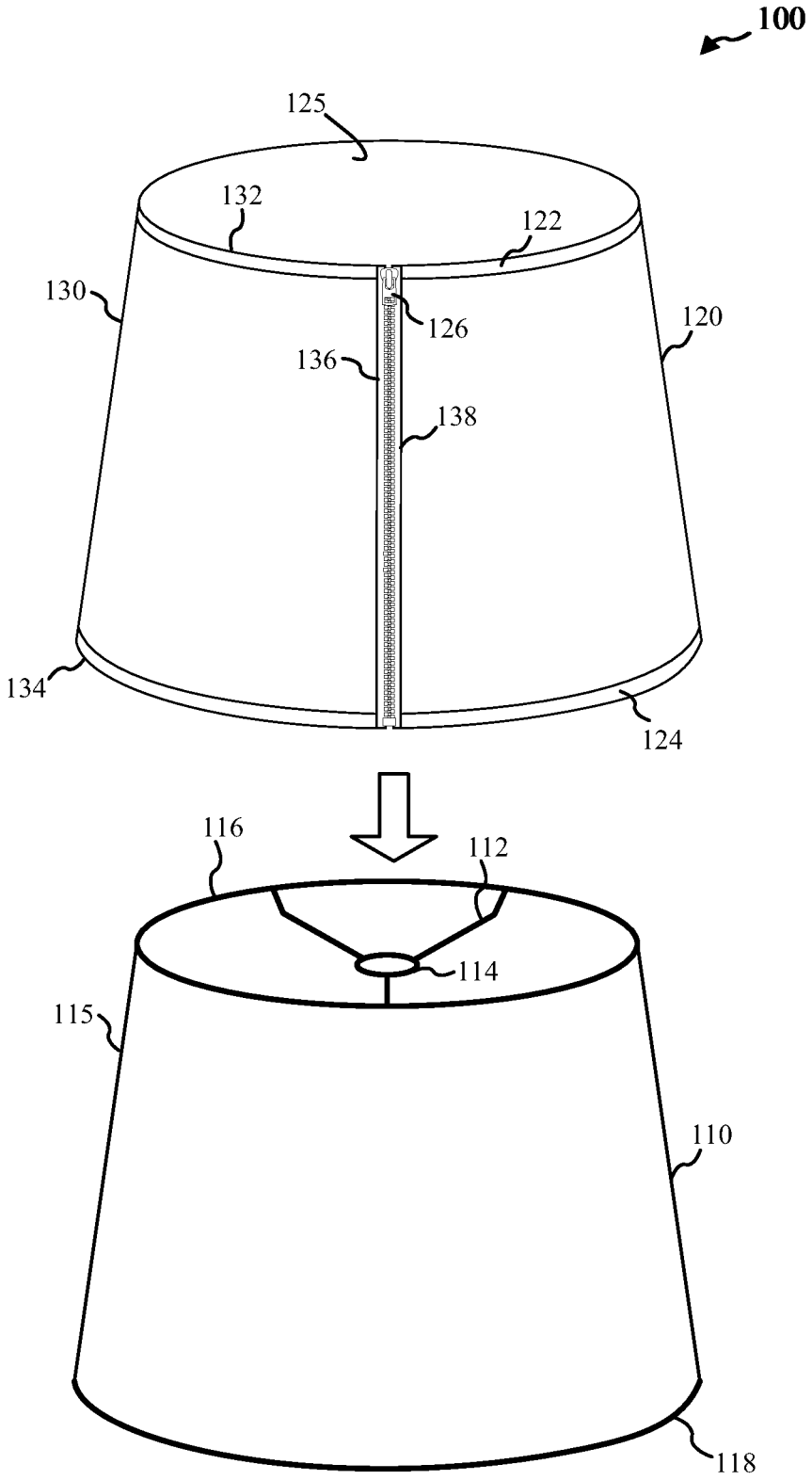
FIG. 1 illustrates an interchangeable lamp shade system 100 that allows easy updating of room decor according to various embodiments of the invention.

FIG. 1 illustrates an interchangeable lamp shade system 100 that allows easy updating of room decor, according to various embodiments. The interchangeable lamp shade system 100 generally includes a lamp shade liner 110 and a lamp shade cover 120. Lamp shade liner 110 may be constructed in a similar manner to typical lamp-shades, without a decorative covering material 115. Lamp shade liner 110 may include a top wire frame 116 that is supported by a spider 112 and a washer 114 that fits over the finial base of a lamp harp (not shown) to support the spider 112. Lamp shade liner 110 could, however, have other configurations including a wire clip that fits on to a light bulb or light bulb socket for lamps that do not have a lamp harp (uno or clip-on lamp shade attachment). Lamp shade liner may have a bottom wire frame 118.

Lamp shade liner 110 may be constructed of various materials commonly used for lamp shade backing. For example, lamp shade liner 110 may be constructed of pressure sensitive styrene ("PSS"). However, other translucent or clear materials may be used for lamp shade liner 110, according to various embodiments.

Lamp shade liner 110 may be various shapes including barrel, cone, or drum-shaped. For example, lamp shade liner 110 may have an 8" diameter at the top, 10" diameter at the bottom, and may be 7" high. In another example, lamp shade liner 110 has an 11" diameter at the top, 13" diameter at the bottom, and may be 9" high. In yet another example, lamp shade liner 110 may have a 13" diameter at the top, a 15" diameter at the bottom, and may be 10" high.

Lamp shade cover 120 is designed to have a decorative look when fitted around lamp shade liner 110. Lamp shade cover 120 generally includes a decorative covering material 130 cut into a pattern that snugly fits over lamp shade liner 110 when lamp shade cover 120 is installed on lamp shade liner 110. The lamp shade cover pattern generally includes a top edge 132, bottom edge 134, first side edge 136, and second side edge 138. In embodiments, lamp shade cover 120 includes a separating closure mechanism 126 that detachably attaches the first side edge 136 and second side edge 138 to form a lamp shade shape from lamp shade cover 120.

Lamp shade cover 120 fits around lamp shade liner 110, and, when separating closure mechanism 126 is closed, creates a lamp shade with a fitted, tailored look. Lamp shade cover 120 can be removed by detaching the coupling mechanism of separating closure mechanism 126 and replaced it with a new lamp shade cover to match changes in decor of a home. For example, lamp shade cover 120 can be interchanged seasonally to match seasonal decor. In one embodiment, separating closure mechanism 126 is a separating zipper. In other embodiments, separating closure mechanism 126 is a separating Velcro closure.

In some embodiments, lamp shade cover 120 is constructed with a decorative covering material 130 adhered to a backing material 125. For example, lamp shade cover 120 may be constructed using self-adhesive PSS as a backing material, covered with fabric of a selected design. However, the backing material for lamp shade cover 120 may be made from other suitable pliable yet rigid materials.

For most lamp shade designs, the weight of lamp shade cover 120 keeps it in place on lamp shade liner 110 without any additional attachment mechanism. It should be appreciated that lamp shade cover 120 could be installed over an existing lamp shade of suitable dimensions as well as lamp shade liner 110.

Another advantage of lamp shade cover 120 according to various embodiments is ease of shipping and storage. For example, lamp shade cover 120 may be removed from lamp shade liner 110 and rolled up to provide a compact package for shipping and storage. In this way, a user may have several lamp shade covers that are easily stored and replaced whenever a change of decor is desired.

Figure 2A:
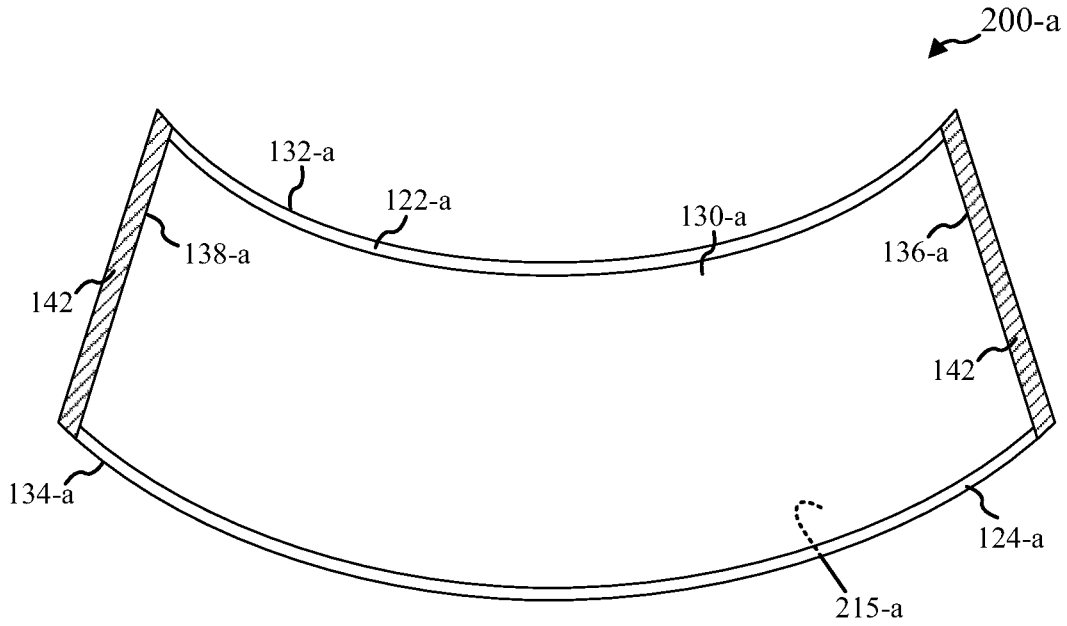
FIG. 2A illustrates a partially constructed lamp shade cover to show construction techniques that may be used to manufacture a lamp shade cover in accordance with various embodiments.
Figure 2B:
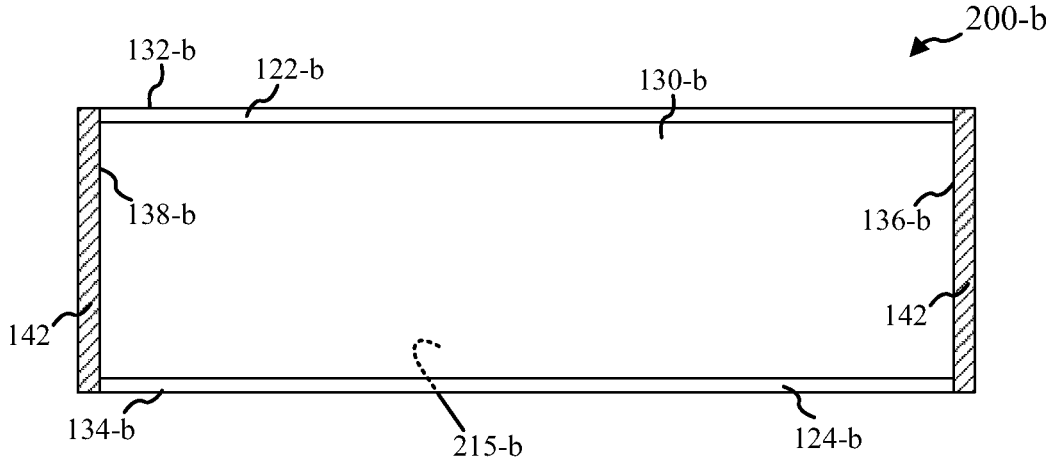
FIG. 2B illustrates a partially constructed lamp shade cover to show construction techniques that may be used to manufacture a lamp shade cover in accordance with various embodiments.

FIGS. 2A and 2B illustrate partially constructed lamp shade covers 200-*a* and 200-*b* to show construction techniques that may be used to manufacture lamp shade cover 120. In a preferred construction technique, the backing material is first cut in a pattern having the dimensions of the desired lamp shade cover. The lamp shade cover pattern is constructed according to art recognized methods for creating a lamp shade. The backing material is then covered with the desired fabric with approximately ½" left on either side, which may be folded over and glued to the back of the PSS. The closure mechanism may then be attached to either end of the PSS arc and trim may be added at the top and/or bottom using glue or other attachment methods. Trim may also be added to border the closure mechanism of the lamp shade cover. In the present embodiment, the closure mechanism used is a separating zipper sewn onto either end of the lamp shade cover.

Partially constructed lamp shade cover 200-*a* may fit over a traditional cone-shaped lamp shade or lamp shade liner 110. Lamp shade cover 200-*a* is illustrated with backing material 215-*a* cut in a lamp shade arc pattern having an arcuate top edge 132-*a*, an arcuate bottom edge 134-*a*, and side edges 136-*a* and 138-*a*. The lamp shade arc pattern may be constructed according to art recognized methods for creating a cone shaped lamp shade. The backing material may be covered in decorative covering material 130-*a* with approximately ½" of material extending past the backing material on side edges 136-*a* and 138-*a*, illustrated as edge material 142. Edge material 142 may be folded over and glued to the back of the backing material 215-*a*. Top trim 122-*a* and bottom trim 124-*a* may be added to lamp shade cover 200-*a*. The closure mechanism may then be attached to either end of the arc pattern to allow the lamp shade cover to be fitted over a lamp shade or lamp shade liner.

Partially constructed lamp shade cover 200-*b* may fit over a cylindrical lamp shade or lamp shade liner 110. Lamp shade cover 200-*b* is illustrated with backing material 215-*b* cut in rectangular pattern having a top edge 132-*b*, a bottom edge 134-*b*, and side edges 136-*b* and 138-*b*. The rectangular lamp shade pattern may be constructed according to art recognized methods for creating a cylindrical shaped lamp shade. The backing material may be covered in decorative covering material 130-*b* with approximately ½" of material extending past the backing material on sides 136-*b* and 138-*b*, illustrated as edge material 142. Edge material 142 may be folded over and glued to the back of the backing material 215-*b*. Top trim 122-*b* and bottom trim 124-*b* may be added to lamp shade cover 200-*b*. The closure mechanism may then be attached to either end of the rectangular lamp shade pattern to allow the lamp shade cover to be fitted over a lamp shade or lamp shade liner.

Figure 3A:
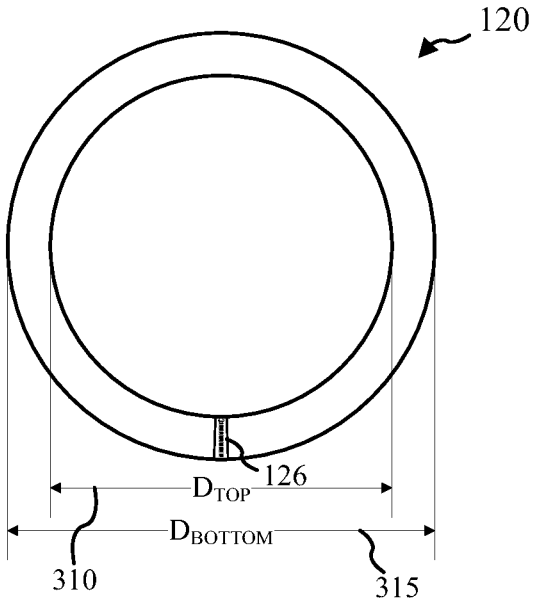
FIG. 3A illustrates a top view of a finished lamp shade cover, according to various embodiments.
Figure 3B:
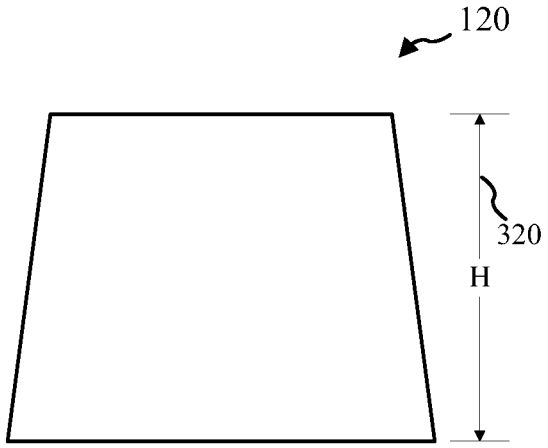
FIG. 3B illustrates a side view of a finished lamp shade cover, according to various embodiments.

FIGS. 3A and 3B illustrate top and side views of a finished lamp shade cover 120 according to various embodiments. As illustrated in FIG. 3A, when the separating closure mechanism 126 is closed, the top edge 132 and bottom edge 134 may form an annular shape. As illustrated in FIGS. 3A and 3B, the dimensions of lamp shade cover 120 may be defined by a top diameter 310, a bottom diameter 315, and a lamp shade height 320. The dimensions of lamp shade cover 120 may be defined by the outer dimensions of lamp shade liner 110, making lamp shade cover 120 fit snugly over lamp shade liner 110 when separating closure mechanism 126 is closed.

Figure 4:
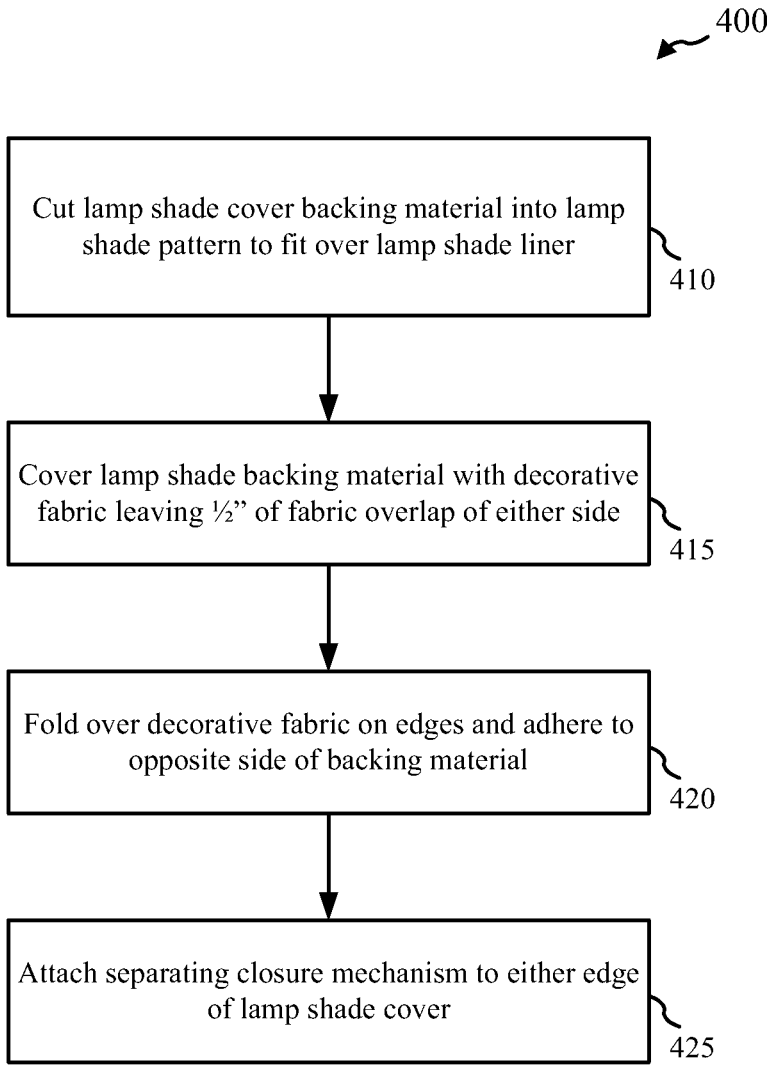
FIG. 4 illustrates a process that may be used to manufacture a lamp shade cover, according to various embodiments.

FIG. 4 illustrates a process 400 that may be used to manufacture a lamp shade cover, according to various embodiments. At step 410, lamp shade backing material may be cut into a lamp shade pattern to fit over a lamp shade or lamp shade liner. The lamp shade backing material may be, for example, PSS lamp shade backing material. At step 415, the lamp shade backing material may be covered with a decorative fabric covering, leaving a small amount of fabric overlapping at the side edges of the backing material. In embodiments, the decorative fabric may overlap the top and/or bottom edges as well.

At step 420 of process 400, the decorative fabric may be folded over and adhered to the back of the backing material. At step 425, a separating closure mechanism is fixed to either side of the lamp shade cover to detachably attach the sides together. In embodiments the separating closure mechanism is a separating zipper. However, Velcro may also be used as a separating closure mechanism for the lamp shade cover. A lamp shade cover constructed according to the process 400 provides the look and feel of a tailored lamp shade without having to remove and store the entire lamp shade.

The foregoing description has been presented for purposes of illustration and description. Specific details are given in the description to provide a thorough understanding of the embodiments. However, it will be understood by one of ordinary skill in the art that the embodiments may be practiced without these specific details. For example, well-known structures, and techniques have been shown without unnecessary detail in order to avoid obscuring the embodiments. Furthermore, the description is not intended to limit embodiments of the invention to the form disclosed herein. While a number of exemplary aspects and embodiments have been discussed above, those of skill in the art will recognize certain variations, modifications, permutations, additions, and subcombinations thereof Thus, various embodiments may omit, substitute, or add various procedures or components as appropriate. It should be noted that the methods, systems and assemblies discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the invention.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, a number of steps may be undertaken before, during, or after the above elements are considered. Accordingly, the above description should not be taken as limiting the scope of the invention.

What is claimed is:

1. A lamp shade cover, comprising:

a pliable backing material in a lamp shade pattern;

a decorative fabric covering, different from the backing material and adhered to the backing material such that the backing material and decorative fabric covering create a multiple-layer lamp shade pattern; and a separating closure mechanism that detachably attaches a first and a second side of the multiple-layer lamp shade pattern, such that when the separating closure mechanism is closed the multiple-layer lamp shade pattern has a lamp shade structure.

2. The lamp shade cover of claim 1, wherein the separating closure mechanism comprises a separating zipper.

3. The lamp shade cover of claim 2, wherein the separating zipper is sewn onto the decorative fabric covering at the first and second sides of the multiple-layer lamp shade pattern.

4. The lamp shade cover of claim 1, wherein the separating closure mechanism comprises a Velcro separating closure.

5. The lamp shade cover of claim 1, wherein the multiple-layer lamp shade pattern comprises an arc lamp shade pattern forming a truncated cone when the separating closure mechanism is closed.

6. The lamp shade cover of claim 1, wherein the multiple-layer lamp shade pattern comprises a rectangular lamp shade pattern forming a cylinder shape when the separating closure mechanism is closed.

7. The lamp shade cover of claim 1, wherein the pliable backing material comprises pressure sensitive styrene.

8. A lamp shade system comprising:

a lamp shade liner forming a lamp shade structure; and a lamp shade cover comprising:

a decorative fabric in a pattern adhered to a pliable backing material to form a multiple-layer lamp shade pattern formed to fit over the lamp shade liner; and a separating closure mechanism separating a first side and a second side of the multiple-layer lamp shade pattern such that when the separating closure mechanism is in a closed position the lamp shade cover is configured to fit snugly over the lamp shade liner.

9. The lamp shade system of claim 8, wherein the separating closure mechanism comprises a separating zipper.

10. The lamp shade system of claim 9, wherein the separating zipper is sewn onto the decorative fabric covering at the first and second sides of the multiple-layer lamp shade pattern.

11. The lamp shade system of claim 8, wherein the separating closure mechanism comprises a Velcro closure mechanism.

12. The lamp shade system of claim 8, wherein the lamp shade liner comprises a top annular wire frame and a bottom annular wire frame.

13. The lamp shade system of claim 12, wherein the top annular wire frame has a smaller diameter than the bottom annular wire frame.

* * * * *